US009744782B1

(12) United States Patent
Sosnowski

(10) Patent No.: US 9,744,782 B1
(45) Date of Patent: Aug. 29, 2017

(54) PRINTING DEVICE PERFORMANCE MANAGEMENT

(71) Applicant: Hewlett-Packard Development Company, L.P., Houston, TX (US)

(72) Inventor: Luke P. Sosnowski, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/296,679

(22) Filed: Oct. 18, 2016

(51) Int. Cl.
*B41J 13/00* (2006.01)
*G03G 15/00* (2006.01)

(52) U.S. Cl.
CPC ..... *B41J 13/0009* (2013.01); *G03G 15/6511* (2013.01)

(58) Field of Classification Search
CPC ..... B65H 2513/10; B65H 2513/20; G03G 2215/00556; G03G 15/6511; G03G 2215/00396; G03G 2215/00455; B41J 11/001; B41J 13/0009; B41J 13/103; Y10S 400/902
See application file for complete search history.

(56) References Cited

U.S. PATENT DOCUMENTS 5,255,904 A * 10/1993 Taguchi ..... G03G 15/6502 271/18.1
7,195,239 B2 3/2007 Saito et al.
8,317,286 B2 11/2012 Ryan et al.
8,340,835 B2 12/2012 Takayama
2008/0063449 A1* 3/2008 Fukasawa ..... B65H 5/34 399/361
2008/0170901 A1 7/2008 Yi

OTHER PUBLICATIONS

Deshpandea, A.V. et al., Design and Implementation of a Dsp Based Inkjet Printer Motion Control System for Dynamic Print Mode Control, 2009. http://web.itu.edu.tr/kamasak/pubs/pdf/paper149.pdf.

* cited by examiner

*Primary Examiner* — Thinh H Nguyen
(74) *Attorney, Agent, or Firm* — Mannava Kang P.C.

(57) ABSTRACT

In some examples, printing device performance management may include determining a physical media feed motor speed of operation for a physical media feed motor for a printing device including the physical media feed motor for transferring a physical medium within a print zone of the printing device, and a further motor for transferring the physical medium towards the print zone. For each physical medium that is to be transferred towards the print zone, the further motor may be actuated to transfer the physical medium at a further motor speed that is greater than the physical media feed motor speed to reduce a further motor duty cycle.

15 Claims, 7 Drawing Sheets

PRINTING DEVICE PERFORMANCE MANAGEMENT

BACKGROUND

A printing device, such as a printer, multifunction printer, and/or other such devices may be described as a peripheral which is used to make a persistent human readable representation of graphics or text on physical media such as paper. Operation of various components of the printing device may be managed based on factors that include printing device throughput, printing quality, etc.

BRIEF DESCRIPTION OF DRAWINGS

Features of the present disclosure are illustrated by way of example and not limited in the following figure(s), in which like numerals indicate like elements, in which.

DETAILED DESCRIPTION

Figure 1:
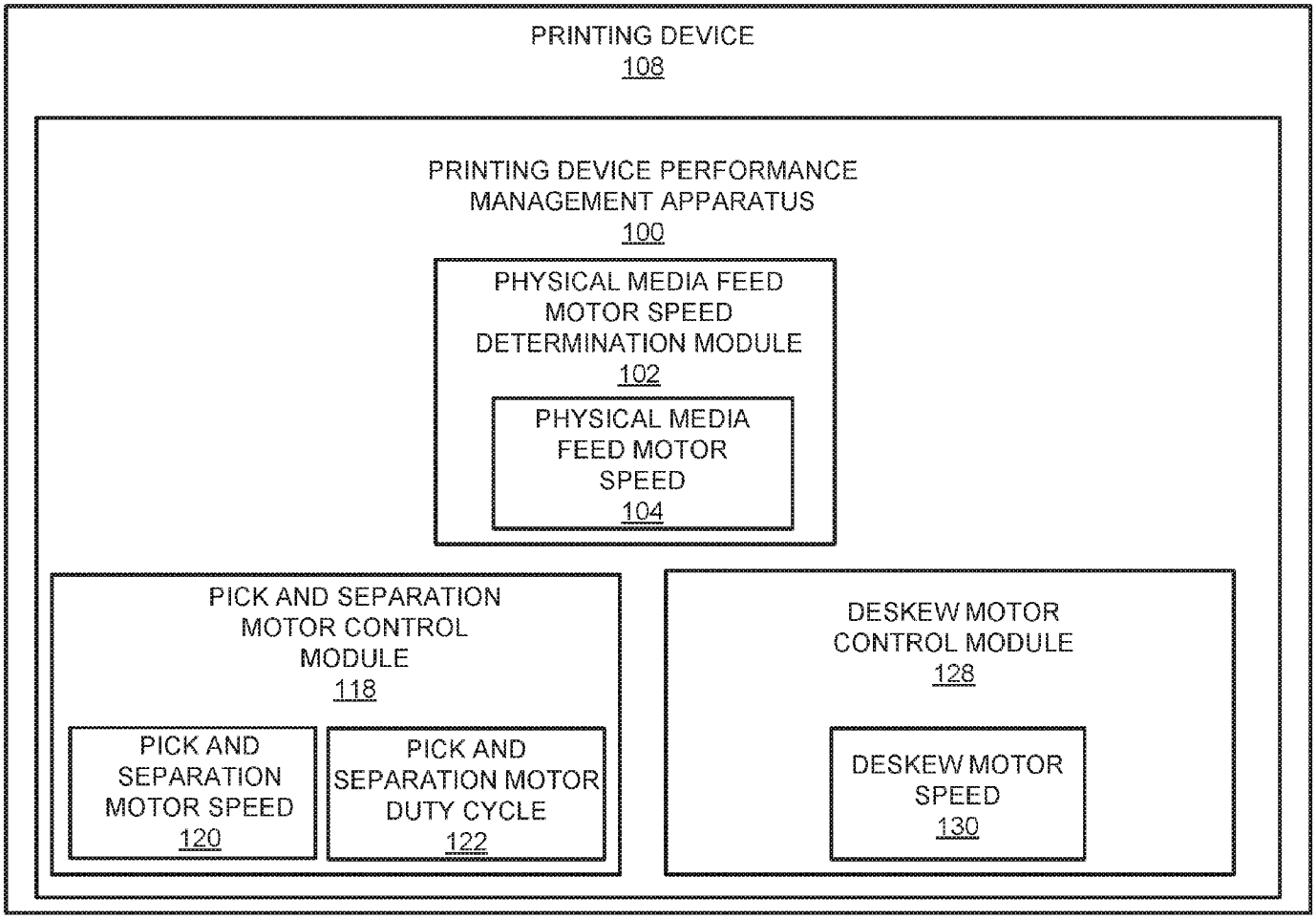
FIG. 1 illustrates a layout of a printing device performance management apparatus, according to an example of the present disclosure.

For simplicity and illustrative purposes, the present disclosure is described by referring mainly to examples. In the following description, numerous specific details are set forth in order to provide a thorough understanding of the present disclosure. It will be readily apparent however, that the present disclosure may be practiced without limitation to these specific details. In other instances, some methods and structures have not been described in detail so as not to unnecessarily obscure the present disclosure.

Throughout the present disclosure, the terms "a" and "an" are intended to denote at least one of a particular element. As used herein, the term "includes" means includes but not limited to, the term "including" means including but not limited to. The term "based on" means based at least in part on.

A printing device performance management apparatus, a method for printing device performance management, and a non-transitory computer readable medium having stored thereon machine readable instructions to provide printing device performance management are disclosed herein. The apparatus, method, and non-transitory computer readable medium disclosed herein provide for an increase in throughput of a printing device based on reduction of a duty cycle of printing device motors such as a pick and separation motor, etc.

A printing device may include motors, such as electric motors, for motion control of physical media (e.g., paper). For example, the pick and separation motor may operate components associated with retrieval and separation of physical media from an input tray. The deskew motor may operate components associated with deskewing (i.e., removal of skew) from the picked and separated physical media. A physical media feed motor may operate components associated with transfer of the physical media within a print zone of the printing device. Such motors are generally operated at high duty cycles and at high loads, relative to their size, for extended periods of time.

In a printing device, motors may be sized smaller than what would be needed to operate at a full rated duty cycle continuously in all conditions. The full rated duty cycle may be based on a speed that is needed to feed the physical media towards and through a print zone to avoid media starvation where physical media is unavailable during a printing process. For example, a motor may be sized to print 1000 sheets of physical media at a specified duty cycle (e.g., 90%, which may correspond to 9 seconds of motor operation per 10 seconds), which corresponds to a specified speed (e.g., 60 sheets/minute), after which the motor may reach an operating temperature threshold, and a thermal protection process may limit the duty cycle (e.g., to 50%) and thus the speed of the printing device (e.g., to 20 sheets/minute), thus reducing throughput. The reduction in throughput of the printing device may result in perceived performance degradation of the printing device.

In order to address the aforementioned technical challenges with respect to printing device throughput reduction, the apparatus, method, and non-transitory computer readable medium disclosed herein provide for a delay in the onset of the thermal protection process, which thus provides an increase in the number of sheets of physical media that may be printed at the full rated speed (e.g., at 60 sheets/minute) of a printing device. In this regard, the apparatus, method, and non-transitory computer readable medium disclosed herein provide for the reduction of the duty cycle of motors such as the pick and separation motor, etc., by operating these motors at a higher speed in a start-stop manner. By operating these motors at higher speeds, longer stop durations may be specified between the pick and separation, and/or deskewing of each physical medium, and transfer of the physical media towards the print zone. The operation of the motors at higher speed and the specification of the longer stop durations results in reduction of the duty cycle of these motors, an increase in the time in which the motors may reach an operating temperature threshold (i.e., based on reduced heat dissipation), and thus an increase in throughput of the printing device before application of the thermal protection process.

For the apparatus, method, and non-transitory computer readable medium disclosed herein, modules, as described herein, may be any combination of hardware and programming to implement the functionalities of the respective modules. In some examples described herein, the combinations of hardware and programming may be implemented in a number of different ways. For example, the programming for the modules may be processor executable instructions stored on a non-transitory machine-readable storage medium and the hardware for the modules may include a processing resource to execute those instructions. In these examples, a computing device implementing such modules may include the machine-readable storage medium storing the instructions and the processing resource to execute the instructions, or the machine-readable storage medium may be separately stored and accessible by the computing device and the processing resource. In some examples, some modules may be implemented in circuitry.

Figure 2A:
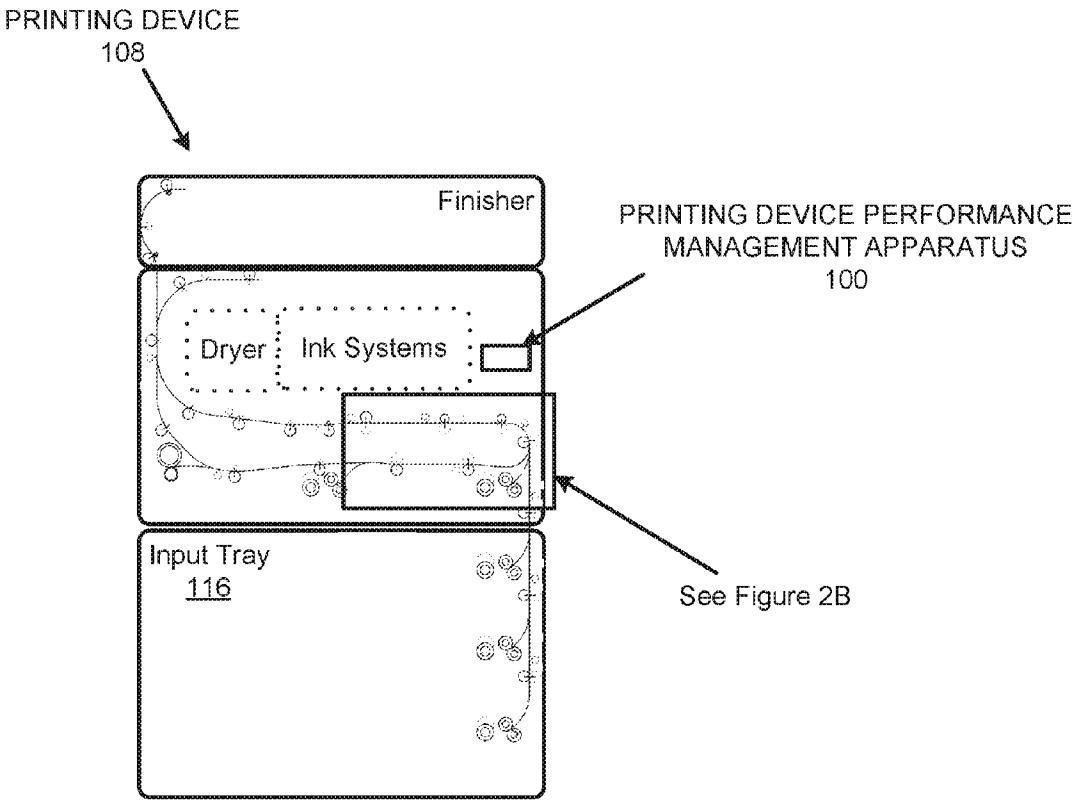
FIG. 2A illustrates a layout of certain components of a printing device to illustrate operation of the printing device performance management apparatus of FIG. 1, according to an example of the present disclosure.
Figure 2B:
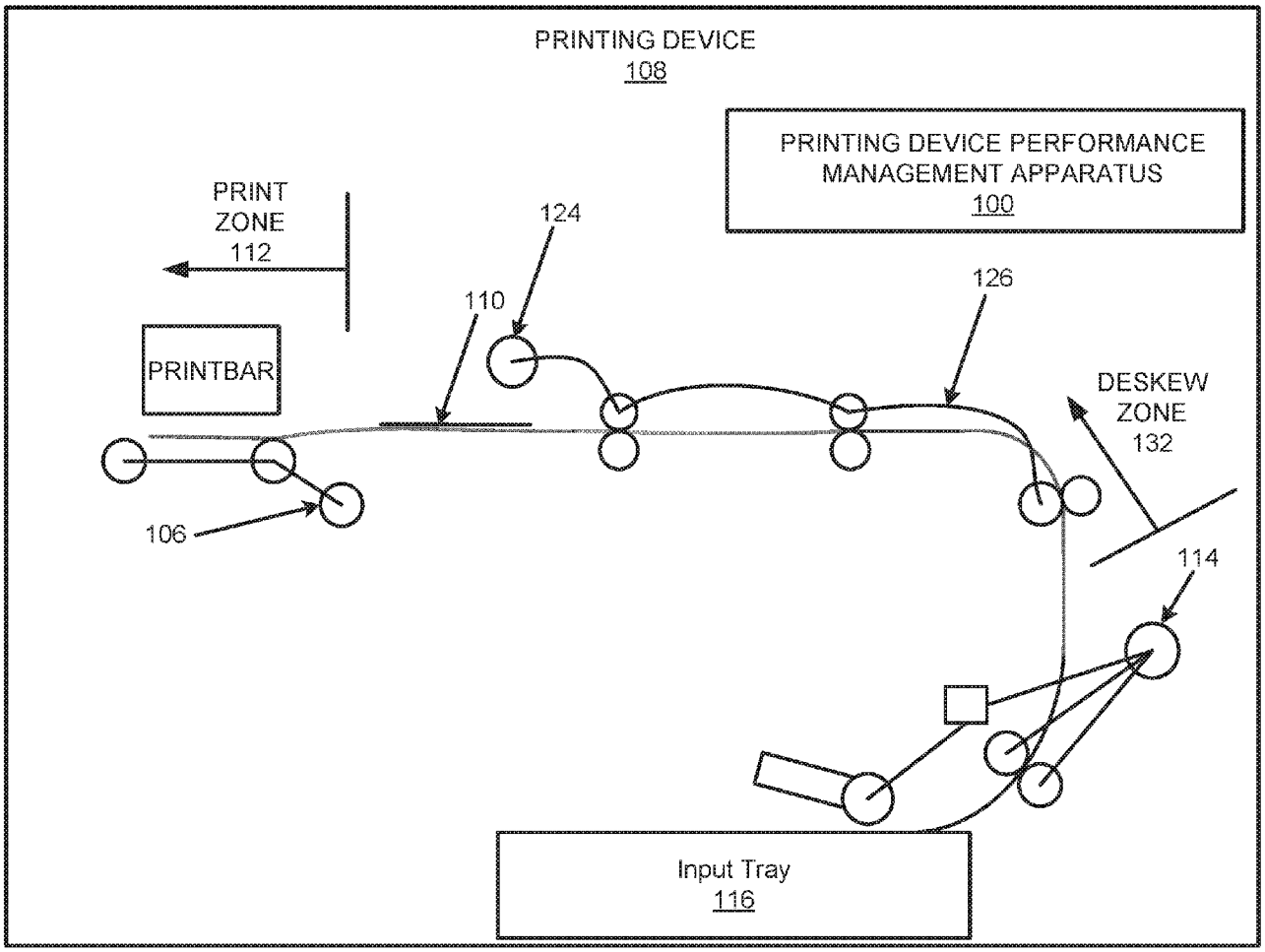
FIG. 2B illustrates an enlarged view of a layout of certain components of the printing device of FIG. 2A to illustrate operation of the printing device performance management apparatus of FIG. 1, according to an example of the present disclosure.

FIG. 1 illustrates a layout of a printing device performance management apparatus (hereinafter also referred to as "apparatus 100"), according to an example of the present disclosure. FIG. 2A illustrates a layout of certain components of a printing device to illustrate operation of the apparatus 100, according to an example of the present disclosure. FIG. 2B illustrates an enlarged view of a layout of certain components of the printing device of FIG. 2A to illustrate operation of the apparatus 100, according to an example of the present disclosure.

In some examples, the apparatus 100 may include or be provided as a component of a print server for processing print data before the processed print data is transmitted to a printing apparatus, such as an inkjet printer, or any type of printing device. Alternatively, as illustrated in FIGS. 1-3B, the apparatus 100 may be a component of a printing device.

Referring to FIGS. 1-2B, the apparatus 100 may include a physical media feed motor speed determination module 102 to determine a physical media feed motor speed 104 of operation for a physical media feed motor 106 (see FIG. 2B) for a printing device 108 including the physical media feed motor 106 for transferring a physical medium 110 (see FIG. 2B) within a print zone 112 (see FIG. 2B) of the printing device 108.

The printing device 108 may further include a pick and separation motor 114 (see FIG. 2B) for picking and separating the physical medium 110 from an input tray 116, and transferring the physical medium 110 towards the print zone 112.

The apparatus 100 may further include a pick and separation motor control module 118 to actuate, for each physical medium 110 that is to be transferred towards the print zone 112, the pick and separation motor 114 to pick and separate the physical medium 110 at a pick and separation motor speed 120 that is greater than the physical media feed motor speed 104 to reduce a pick and separation motor duty cycle 122 (as well as to reduce a rate of increase of an operating temperature of the pick and separation motor 114).

Figure 3A:
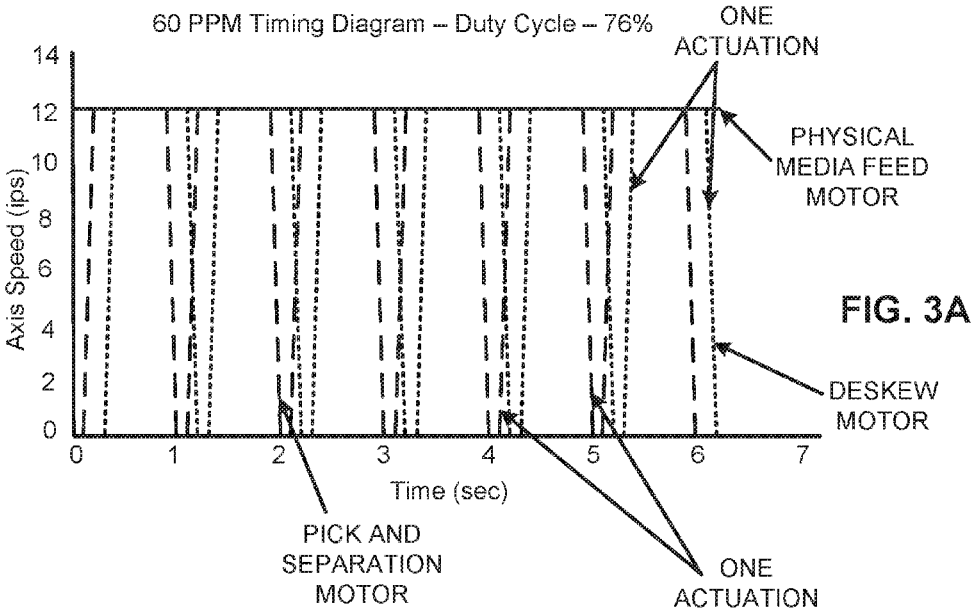
FIGS. 3A and 3B respectively illustrate timing diagrams of motor duty cycle without and with application of duty cycle reduction for the printing device performance management apparatus of FIG. 1, according to an example of the present disclosure.
Figure 3B:
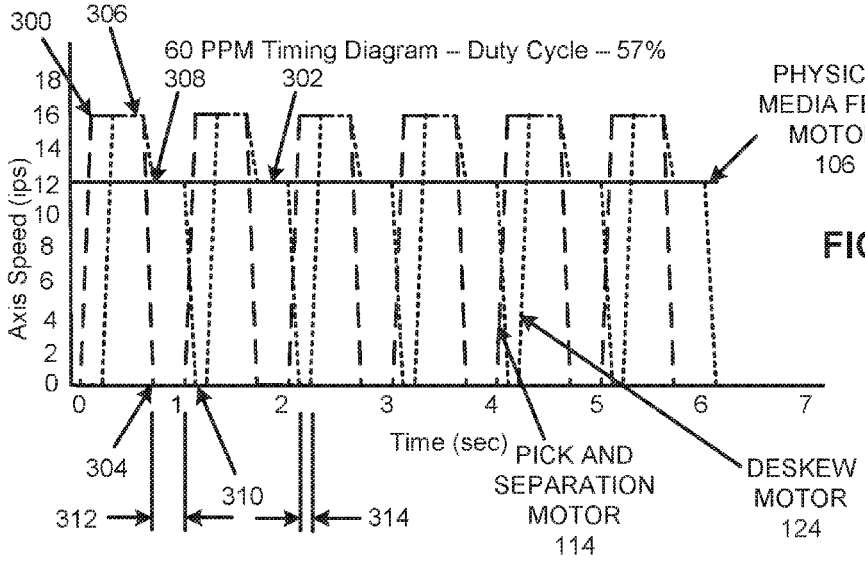

For example, FIGS. 3A and 3B respectively illustrate timing diagrams of motor duty cycle without and with application of duty cycle reduction for the apparatus 100, according to an example of the present disclosure. Compared to the timing diagram of FIG. 3A which includes an approximately 76% duty cycle for the pick and separation motor 114, the timing diagram of FIG. 3B includes an approximately 57% duty cycle for the pick and separation motor 114 (i.e., a reduction in the heat dissipation by approximately 25%). In this regard, referring to FIG. 3B, the pick and separation motor control module 118 may actuate, for each physical medium 110 that is to be transferred towards the print zone 112, the pick and separation motor 114 to pick and separate the physical medium 110 at a pick and separation motor speed 120 of approximately 16 inches per second (ips, e.g., at 300) which is greater than the physical media feed motor speed 104 of approximately 12 ips (e.g., at 302) to reduce a pick and separation motor duty cycle 122 from approximately 76% to approximately 57%.

The pick and separation motor control module 118 may reduce, after completion of each transfer of the physical medium 110 towards a deskew zone 132 (and generally towards the print zone 112), the pick and separation motor speed 120 to a speed (e.g., a first speed) below the physical media feed motor speed 104 for picking and separating a next physical medium. For example, referring to FIG. 3B, the pick and separation motor control module 118 may reduce (e.g., at 304), after completion of each transfer of the physical medium 110 towards the deskew zone 132, the pick and separation motor speed 120 to a speed (e.g., a first speed) below the physical media feed motor speed 104 for picking and separating a next physical medium. In this regard, although the reduction at 304 is illustrated as being a zero speed of the pick and separation motor 114, the reduction at 304 may be greater than zero (e.g., less than 12 ips and greater than 0 ips).

According to an example, the pick and separation motor control module 118 may reduce, after completion of each transfer of the physical medium 110 towards the deskew zone 132, the pick and separation motor speed 120 to approximately zero prior to picking and separating the next physical medium. For example, referring to FIG. 3B, the pick and separation motor control module 118 may reduce (e.g., at 304), after completion of each transfer of the physical medium 110 towards the deskew zone 132, the pick and separation motor speed 120 to approximately zero prior to picking and separating the next physical medium.

Referring to FIG. 2B, a deskew motor 124 may be operable along a physical media path 126 between the input tray 116 and the print zone 112. In this regard, the apparatus 100 may further include a deskew motor control module 128 to actuate, for each picked and separated physical medium that is to be transferred towards the print zone 112, the deskew motor 124 to deskew the physical medium 110 at a deskew motor speed 130 that is greater than the physical media feed motor speed 104.

For example, referring to FIG. 3B, in a similar manner as reduction of the pick and separation motor duty cycle 122 from approximately 76% to approximately 57%, the deskew motor control module 128 may actuate, for each picked and separated physical medium that is to be transferred towards the print zone 112, the deskew motor 124 to deskew the physical medium 110 at a deskew motor speed 130 of approximately 16 ips (e.g., at 306) that is greater than the physical media feed motor speed 104 of approximately 12 ips (e.g., at 302).

The deskew motor control module 128 may reduce, prior to each transfer of the deskewed physical medium towards the print zone 112, the deskew motor speed 130 to the physical media feed motor speed 104 until transfer of the deskewed physical medium to the print zone 112. For example, referring to FIG. 3B, the deskew motor control module 128 may reduce (e.g., at 308), prior to each transfer of the deskewed physical medium towards the print zone 112, the deskew motor speed 130 to the physical media feed motor speed 104 until transfer of the deskewed physical medium to the print zone 112.

The deskew motor control module 128 may further reduce, after completion of each transfer of the deskewed physical medium to the print zone 112, the deskew motor speed 130 to a speed (e.g., a second speed) below the physical media feed motor speed 104 for deskewing the next physical medium. For example, referring to FIG. 3B, the deskew motor control module 128 may further reduce (e.g., at 310), after completion of each transfer of the deskewed physical medium to the print zone 112, the deskew motor speed 130 to a speed (e.g., a second speed) below the physical media feed motor speed 104 for deskewing the next physical medium. In this regard, although the reduction at 310 is illustrated as being a zero speed of the deskew motor 124, the reduction at 310 may be greater than zero (e.g., less than 12 ips and greater than 0 ips).

According to an example, the deskew motor control module 128 may further reduce, after completion of each transfer of the deskewed physical medium to the print zone 112, the deskew motor speed 130 to approximately zero prior to deskewing the next physical medium. For example, referring to FIG. 3B, the deskew motor control module 128 may further reduce (e.g., at 310), after completion of each transfer of the deskewed physical medium to the print zone 112, the deskew motor speed 130 to approximately zero prior to deskewing the next physical medium.

According to an example, the first speed may be equal to the second speed. For example, referring to FIG. 3B, the first speed (e.g., at 304) may be equal to the second speed (e.g., at 310).

According to an example, the pick and separation motor control module 118 may reduce, after completion of each transfer of the physical medium towards the print zone 112, the pick and separation motor speed 120 to the first speed for a first time duration. Further, the deskew motor control module 128 may reduce, after completion of each transfer of the deskewed physical medium to the print zone 112, the deskew motor speed 130 to the second speed for a second time duration that is less than the first time duration.

For example, referring to FIG. 3B, the pick and separation motor control module 118 may reduce, after completion of each transfer of the physical medium towards the print zone 112, the pick and separation motor speed 120 to the first speed for a first time duration (e.g., at 312). Further, the deskew motor control module 128 may reduce, after completion of each transfer of the deskewed physical medium to the print zone 112, the deskew motor speed 130 to the second speed for a second time duration (e.g., at 314) that is less than the first time duration.

According to an example, the printing device may include a further motor (e.g., the pick and separation motor 114, or another motor) for transferring the physical medium 110 towards the print zone 112. In this regard, an associated further motor control module (e.g., the pick and separation motor control module 118, or another motor control module) may actuate, for each physical medium that is to be transferred towards the print zone 112, the further motor to transfer the physical medium at a further motor speed that is greater than the physical media feed motor speed 104 to reduce the pick and separation motor 114 duty cycle. In this regard, if additional motors are provided between the pick and separation motor 114 and the deskew motor 124, the duty cycle of the additional motors may be reduced in a similar manner as the pick and separation motor 114 duty cycle.

According to an example, the associated further motor control module may reduce, after completion of each transfer of the physical medium towards the print zone 112, the further motor speed to a speed below (e.g., in a similar manner as disclosed herein with respect to FIG. 3B) the physical media feed motor speed 104 to transfer a next physical medium. For example, the associated further motor control module may reduce, after completion of each transfer of the physical medium towards the print zone 112, the further motor speed to approximately zero (e.g., in a similar manner as disclosed herein with respect to FIG. 3B) prior to transferring the next physical medium to reduce the further motor duty cycle.

Referring again to FIGS. 3A and 3B, in order to estimate the decrease in average power dissipation for the pick and separation motor 114 (as well as for other motors such as the deskew motor 124, etc.), power dissipated as heat by an electric motor may be expressed as follows:

$$P_R = I^2 * R \qquad \text{Equation (1)}$$

For Equation (1), $P_R$ may represent the power dissipated by a motor as heat, I may represent the current being driven across the motor in Amperes, and R may represent the motor resistance in Ohms. The current I may be directly proportional to the mechanical torque driven by the motor. Based on various data measurements, for the example of FIG. 3B, the current to speed relationship on the pick and separation motor 114 may be expressed as follows:

$$I = 0.0057v + 0.39 \qquad \text{Equation (2)}$$

For Equation (2), v may represent the physical medium velocity in ips. For the speeds in the example of FIG. 3B, assuming that the currents are I(12)=0.458 Ampere, and I(16)=0.481 Ampere, the $P_R$ ratio may be estimated as follows:

$$\frac{P_{R16}}{P_{R12}} = \frac{I(16)^2}{I(12)^2} = 1.10$$

Based on these estimates, it can be seen that operating the pick and separation motor 114 at a higher speed increases the power dissipation by approximately 10%. For a motor, the duty cycle (D) may be estimated as follows:

$$D = \frac{T_{on}}{T_{on} + T_{off}} \qquad \text{Equation (3)}$$

For Equation (3), $T_{on}$ may represent the time when the motor is energized, and $T_{off}$ may represent the time that the motor is turned off. The motor may generate heat when it is in the $T_{on}$ state, and not generate any heat in the $T_{off}$ state. Further, the motor may dissipate heat based on its temperature regardless of whether the motor is on or off. The heating time constant of the motor may be measured in minutes. The cycle time of a physical medium may be measured in a second or less. As a result, the thermal mass of the motor may be used to average the heat input into the motor. Based on the foregoing, for the example of FIG. 3B, increasing the speed of the pick and separation motor 114 from 12 to 16 ips reduces the duty cycle from approximately 76% to approximately 57%. The average power generated by the motor may then be estimated as a product of duty cycle and the continuous duty power generation as follows:

$$P_{AVE} = D * P_R \qquad \text{Equation (4)}$$

The ratio of the average power dissipation between 16 and 12 ips may be estimated as follows:

$$\frac{P_{AVE16}}{P_{AVE12}} = \frac{D_{16}}{D_{12}} * \frac{P_{R16}}{P_{R12}} = \frac{0.57}{0.76} * 1.1 = 0.825$$

Since the ratio is less than one, this means that the average power dissipated has decreased, and for the example of FIG. 3B, by 17.5%. Further, since the printing speed has not changed for the example of FIG. 3B, this means that the pick and separation motor 114 may be operated longer without reaching an operating temperature threshold, beyond which the pick and separation motor 114 may need to be stopped or operated at a reduced duty cycle.

As will be appreciated, some examples of the apparatus 100 may be configured with more or less modules, where modules may be configured to perform more or less operations. Furthermore, in some examples, the modules may be implemented by execution of instructions with a processing resource to cause the processing resource to perform the corresponding operations.

Figure 4:
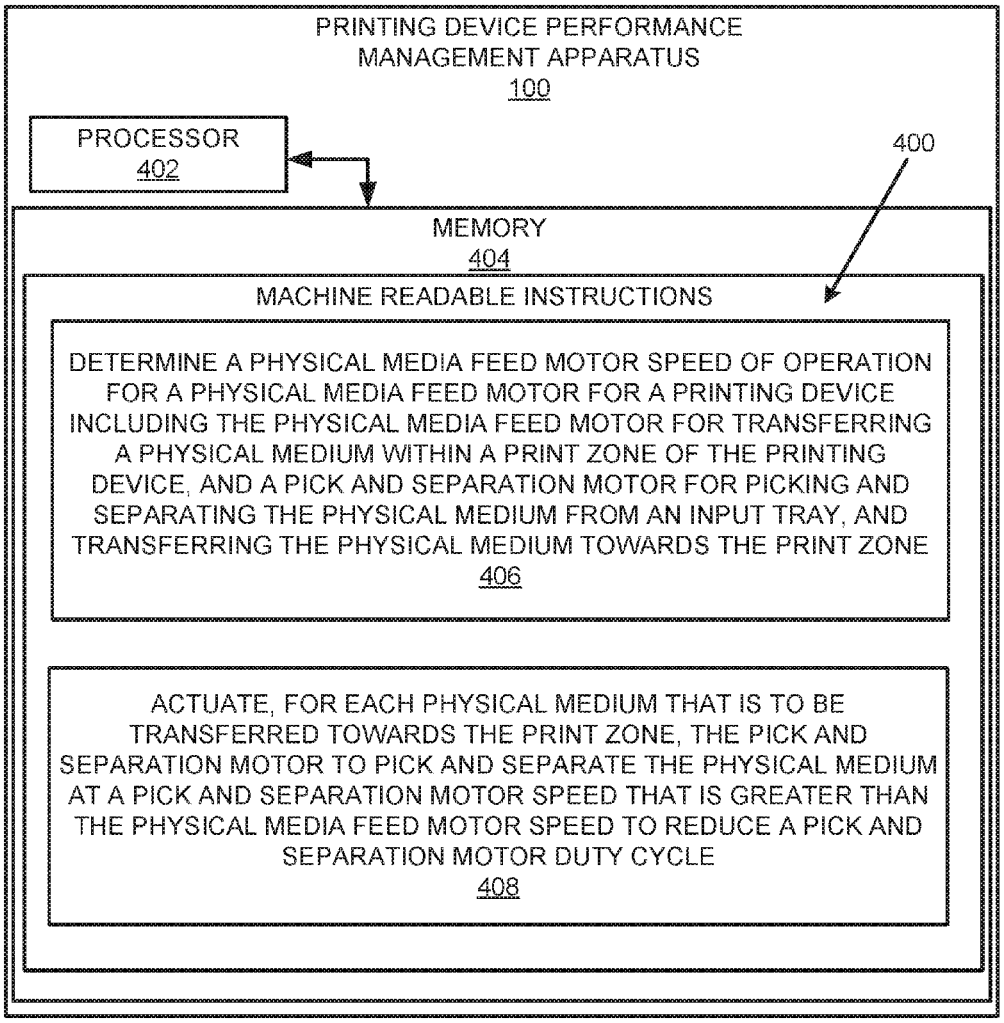
FIG. 4 illustrates a block diagram for printing device performance management, according to an example of the present disclosure.
Figure 5:
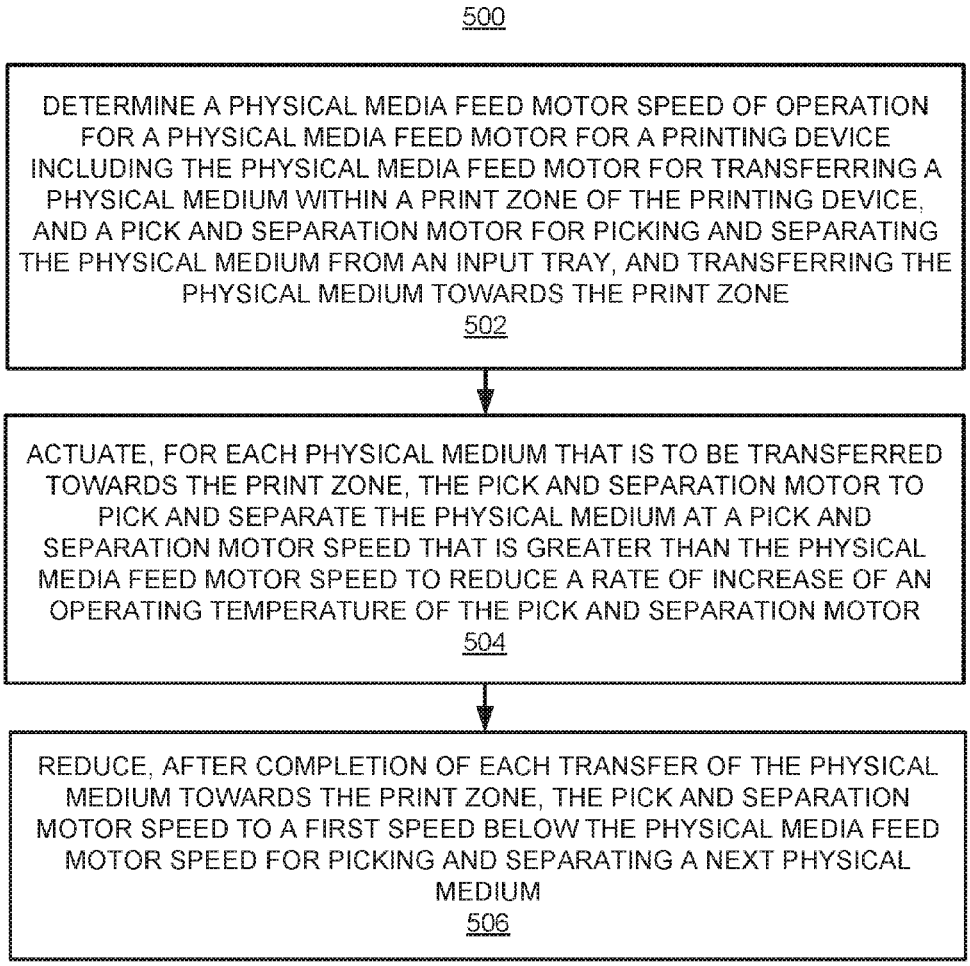
FIG. 5 illustrates a flowchart of a method for printing device performance management, according to an example of the present disclosure.
Figure 6:
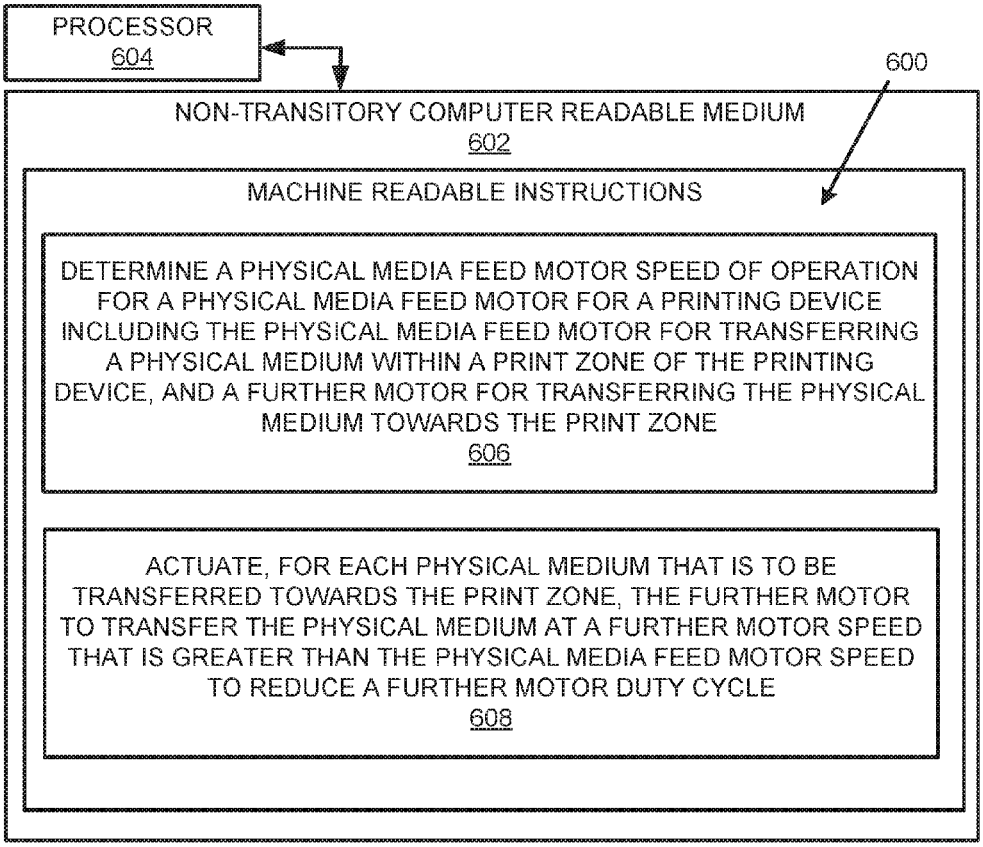
FIG. 6 illustrates a further block diagram for printing device performance management, according to an example of the present disclosure.

FIGS. 4-6 respectively illustrate a block diagram 400, a flowchart of a method 500, and a further block diagram 600 for printing device performance management, according to examples. The block diagram 400, the method 500, and the block diagram 600 may be implemented on the apparatus 100 described above with reference to FIG. 1 by way of example and not limitation. The block diagram 400, the method 500, and the block diagram 600 may be practiced in other apparatus. In addition to showing the block diagram 400, FIG. 4 shows hardware of the apparatus 100 that may execute the instructions of the block diagram 400. The hardware may include a processor 402, and a memory 404 storing machine readable instructions that when executed by the processor cause the processor to perform the instructions of the block diagram 400. The memory 404 may represent a non-transitory computer readable medium. FIG. 5 may represent a method for printing device performance management, and the steps of the method. FIG. 6 may represent a non-transitory computer readable medium 602 having stored thereon machine readable instructions to provide printing device performance management. The machine readable instructions, when executed, cause a processor 604 to perform the instructions of the block diagram 600 also shown in FIG. 6.

The processor 402 of FIG. 4 and/or the processor 604 of FIG. 6 may include a single or multiple processors or other hardware processing circuit, to execute the methods, functions and other processes described herein. These methods, functions and other processes may be embodied as machine readable instructions stored on a computer readable medium, which may be non-transitory (e.g., the non-transitory computer readable medium 602 of FIG. 6), such as hardware storage devices (e.g., RAM (random access memory), ROM (read only memory), EPROM (erasable, programmable ROM), EEPROM (electrically erasable, programmable ROM), hard drives, and flash memory). The memory 404 may include a RAM, where the machine readable instructions and data for a processor may reside during runtime.

Referring to FIGS. 1-4, and particularly to the block diagram 400 shown in FIG. 4, at block 406, the memory 404 may include instructions to determine a physical media feed motor speed 104 of operation for a physical media feed motor 106 for a printing device 108 including the physical media feed motor 106 for transferring a physical medium 110 within a print zone 112 of the printing device 108, and a pick and separation motor 114 for picking and separating the physical medium 110 from an input tray 116, and transferring the physical medium 110 towards the print zone 112.

At block 408, the memory 404 may include instructions to actuate, for each physical medium 110 that is to be transferred towards the print zone 112, the pick and separation motor 114 to pick and separate the physical medium 110 at a pick and separation motor speed 120 that is greater than the physical media feed motor speed 104 to reduce a pick and separation motor duty cycle 122.

Referring to FIGS. 1-3B, and 5, and particularly FIG. 5, for the method 500, at block 502, the method may include determining a physical media feed motor speed 104 of operation for a physical media feed motor 106 for a printing device 108 including the physical media feed motor 106 for transferring a physical medium 110 within a print zone 112 of the printing device 108, and a pick and separation motor 114 for picking and separating the physical medium 110 from an input tray 116, and transferring the physical medium 110 towards the print zone 112.

At block 504, the method may include actuating, for each physical medium 110 that is to be transferred towards the print zone 112, the pick and separation motor 114 to pick and separate the physical medium 110 at a pick and separation motor speed 120 that is greater than the physical media feed motor speed 104 to reduce a rate of increase of an operating temperature of the pick and separation motor 114.

At block 506, the method may include reducing, after completion of each transfer of the physical medium 110 towards the print zone 112, the pick and separation motor speed 120 to a first speed below the physical media feed motor speed 104 for picking and separating a next physical medium 110.

Referring to FIGS. 1-3B, and 6, and particularly FIG. 6, for the block diagram 600, at block 606, the non-transitory computer readable medium 602 may include instructions to determine a physical media feed motor speed 104 of operation for a physical media feed motor 106 for a printing device 108 including the physical media feed motor 106 for transferring a physical medium 110 within a print zone 112 of the printing device 108, and a further motor for transferring the physical medium 110 towards the print zone 112.

At block 608, the non-transitory computer readable medium 602 may include instructions to actuate, for each physical medium 110 that is to be transferred towards the print zone 112, the further motor to transfer the physical medium 110 at a further motor speed that is greater than the physical media feed motor speed 104 to reduce a further motor duty cycle.

What has been described and illustrated herein is an example along with some of its variations. The terms, descriptions and figures used herein are set forth by way of illustration only and are not meant as limitations. Many variations are possible within the spirit and scope of the subject matter, which is intended to be defined by the following claims—and their equivalents—in which all terms are meant in their broadest reasonable sense unless otherwise indicated.

What is claimed is:

1. A printing device performance management apparatus comprising:

a processor; and a memory storing machine readable instructions that when executed by the processor cause the processor to:

determine a physical media feed motor speed of operation for a physical media feed motor for a printing device including the physical media feed motor for transferring a physical medium within a print zone of the printing device, and a pick and separation motor for picking and separating the physical medium from an input tray, and transferring the physical medium towards the print zone; and actuate, for each physical medium that is to be transferred towards the print zone, the pick and separation motor to pick and separate the physical medium at a pick and separation motor speed that is greater than the physical media feed motor speed to reduce a pick and separation motor duty cycle.

2. The apparatus according to claim 1, wherein the machine readable instructions, when executed by the processor, further cause the processor to:

reduce, after completion of each transfer of the physical medium towards the print zone, the pick and separation motor speed to a speed below the physical media feed motor speed for picking and separating a next physical medium.

3. The apparatus according to claim 2, wherein the machine readable instructions to reduce, after completion of each transfer of the physical medium towards the print zone, the pick and separation motor speed to the speed below the physical media feed motor speed for picking and separating the next physical medium further comprise machine readable instructions to cause the processor to:

reduce, after completion of each transfer of the physical medium towards the print zone, the pick and separation motor speed to approximately zero prior to picking and separating the next physical medium.

4. The apparatus according to claim 1, further comprising a deskew motor operable along a physical media path between the input tray and the print zone, wherein the machine readable instructions, when executed by the processor, further cause the processor to:

actuate, for each picked and separated physical medium that is to be transferred towards the print zone, the deskew motor to deskew the physical medium at a deskew motor speed that is greater than the physical media feed motor speed;

reduce, prior to each transfer of the deskewed physical medium towards the print zone, the deskew motor speed to the physical media feed motor speed until transfer of the deskewed physical medium to the print zone; and further reduce, after completion of each transfer of the deskewed physical medium to the print zone, the deskew motor speed to a speed below the physical media feed motor speed for deskewing the next physical medium.

5. The apparatus according to claim 4, wherein the machine readable instructions to further reduce, after completion of each transfer of the deskewed physical medium to the print zone, the deskew motor speed to the speed below the physical media feed motor speed for deskewing the next physical medium further comprise machine readable instructions to cause the processor to:

further reduce, after completion of each transfer of the deskewed physical medium to the print zone, the deskew motor speed to approximately zero prior to deskewing the next physical medium.

6. The apparatus according to claim 1, further comprising a deskew motor operable along a physical media path between the input tray and the print zone, wherein the machine readable instructions, when executed by the processor, further cause the processor to:

reduce, after completion of each transfer of the physical medium towards the print zone, the pick and separation motor speed to a first speed below the physical media feed motor speed for picking and separating a next physical medium;

actuate, for each picked and separated physical medium that is to be transferred towards the print zone, the deskew motor to deskew the physical medium at a deskew motor speed that is greater than the physical media feed motor speed;

reduce, prior to each transfer of the deskewed physical medium towards the print zone, the deskew motor speed to the physical media feed motor speed until transfer of the deskewed physical medium to the print zone; and further reduce, after completion of each transfer of the deskewed physical medium to the print zone, the deskew motor speed to a second speed below the physical media feed motor speed for deskewing the next physical medium.

7. The apparatus according to claim 6, wherein the first speed is equal to the second speed.

8. The apparatus according to claim 6, wherein the machine readable instructions to reduce, after completion of each transfer of the physical medium towards the print zone, the pick and separation motor speed to the first speed below the physical media feed motor speed for picking and separating the next physical medium, and further reduce, after completion of each transfer of the deskewed physical medium to the print zone, the deskew motor speed to the second speed below the physical media feed motor speed for deskewing the next physical medium further comprise machine readable instructions to cause the processor to:

reduce, after completion of each transfer of the physical medium towards the print zone, the pick and separation motor speed to the first speed for a first time duration; and further reduce, after completion of each transfer of the deskewed physical medium to the print zone, the deskew motor speed to the second speed for a second time duration that is less than the first time duration.

9. A method for printing device performance management comprising:

determining a physical media feed motor speed of operation for a physical media feed motor for a printing device including the physical media feed motor for transferring a physical medium within a print zone of the printing device, and a pick and separation motor for picking and separating the physical medium from an input tray, and transferring the physical medium towards the print zone;

actuating, for each physical medium that is to be transferred towards the print zone, the pick and separation motor to pick and separate the physical medium at a pick and separation motor speed that is greater than the physical media feed motor speed to reduce a rate of increase of an operating temperature of the pick and separation motor; and reducing, after completion of each transfer of the physical medium towards the print zone, the pick and separation motor speed to a first speed below the physical media feed motor speed for picking and separating a next physical medium.

10. The method according to claim 9, further comprising:

actuating, for each picked and separated physical medium that is to be transferred towards the print zone, a deskew motor to deskew the physical medium at a deskew motor speed that is greater than the physical media feed motor speed, wherein the deskew motor is operable along a physical media path between the input tray and the print zone;

reduce, prior to each transfer of the deskewed physical medium towards the print zone, the deskew motor speed to the physical media feed motor speed until transfer of the deskewed physical medium to the print zone; and further reduce, after completion of each transfer of the deskewed physical medium to the print zone, the deskew motor speed to a second speed below the physical media feed motor speed for deskewing the next physical medium.

11. The method according to claim 10, wherein the first speed is equal to the second speed.

12. The method according to claim 10, wherein reducing, after completion of each transfer of the physical medium towards the print zone, the pick and separation motor speed to the first speed below the physical media feed motor speed for picking and separating the next physical medium, and further reducing, after completion of each transfer of the deskewed physical medium to the print zone, the deskew motor speed to the second speed below the physical media feed motor speed for deskewing the next physical medium further comprises:

reducing, after completion of each transfer of the physical medium towards the print zone, the pick and separation motor speed to the first speed for a first time duration; and further reducing, after completion of each transfer of the deskewed physical medium to the print zone, the deskew motor speed to the second speed for a second time duration that is less than the first time duration.

13. A non-transitory computer readable medium having stored thereon machine readable instructions to provide printing device performance management, the machine readable instructions, when executed, cause a processor to:

determine a physical media feed motor speed of operation for a physical media feed motor for a printing device including the physical media feed motor for transferring a physical medium within a print zone of the printing device, and a further motor for transferring the physical medium towards the print zone; and actuate, for each physical medium that is to be transferred towards the print zone, the further motor to transfer the physical medium at a further motor speed that is greater than the physical media feed motor speed to reduce a further motor duty cycle.

14. The non-transitory computer readable medium according to claim 13, further comprising machine readable instructions, when executed, further cause the processor to:

reduce, after completion of each transfer of the physical medium towards the print zone, the further motor speed to a speed below the physical media feed motor speed to transfer a next physical medium.

15. The non-transitory computer readable medium according to claim 14, wherein the machine readable instructions to reduce, after completion of each transfer of the physical medium towards the print zone, the further motor speed to the speed below the physical media feed motor speed to transfer the next physical medium, when executed, further cause the processor to:

reduce, after completion of each transfer of the physical medium towards the print zone, the further motor speed to approximately zero prior to transferring the next physical medium to reduce the further motor duty cycle.

* * * * *